United States Patent [19]

Metzger

[11] 4,295,508

[45] Oct. 20, 1981

[54] FLEXIBLE GARBAGE CAN LID

[76] Inventor: Harold L. Metzger, 1402 Fredericksburg Rd., San Antonio, Tex. 78201

[21] Appl. No.: 141,288

[22] Filed: Apr. 18, 1980

[51] Int. Cl.[3] ..... B65D 65/02; B65B 11/00

[52] U.S. Cl. ..... 150/52 R; 220/1 T; 220/320

[58] Field of Search ..... 220/1 T, 320; 150/0.5, 150/52 R

[56] References Cited

U.S. PATENT DOCUMENTS 2,821,230 1/1958 May ..... 152/52 R 3,346,139 10/1967 Armstrong ..... 220/320

*Primary Examiner*—George T. Hall

*Attorney, Agent, or Firm*—Ranseler O. Wyatt

[57] ABSTRACT

A lid for a garbage can formed of a flexible material and having a retaining means for releasably maintaining the cover in place.

1 Claim, 3 Drawing Figures

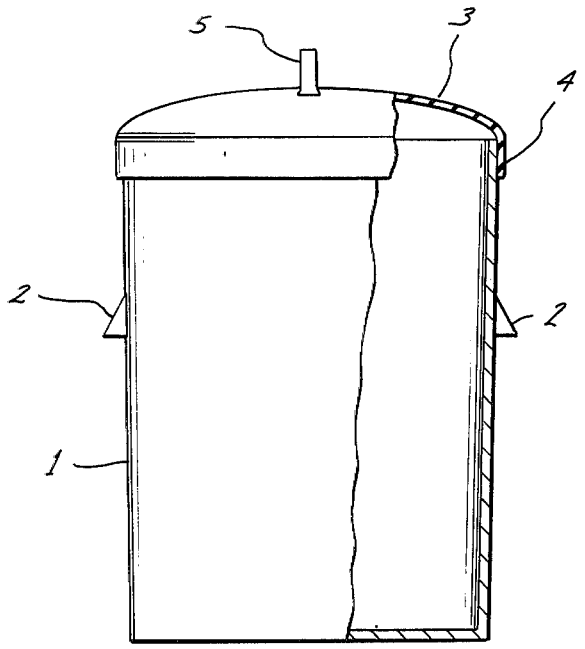
Fig. 1
Fig. 2
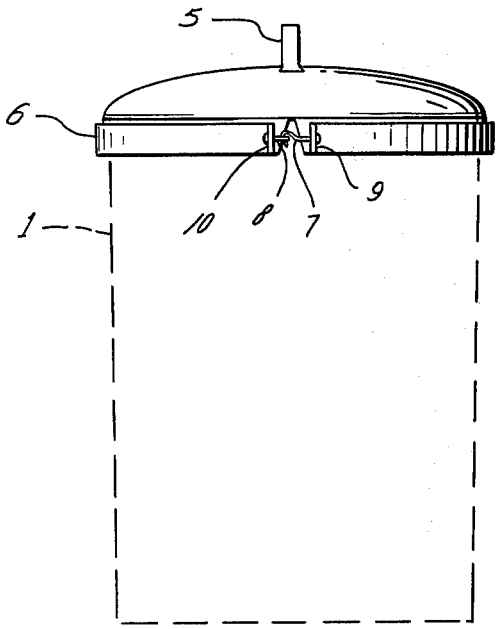
Fig. 3
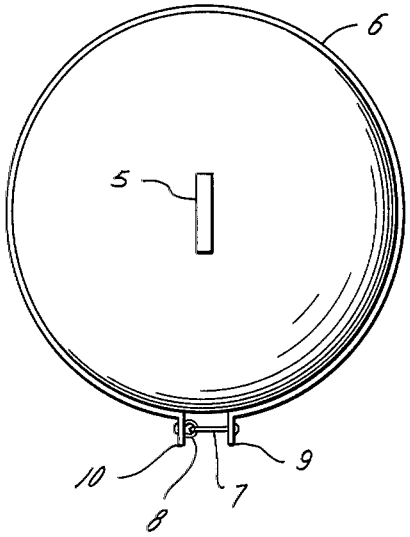

FLEXIBLE GARBAGE CAN LID

BACKGROUND OF THE INVENTION

Garbage can lids often fall off when the cans are tipped over by dogs, and the like, scattering the contents, and causing unsightly and unhealthy conditions, and such cans are subjected to unusually harsh treatment, particularly at the hands of the collectors, who knock the lids of and strike the cans against the garbage truck to loosen its contents, resulting in bending and distorting the contour of the top margin of the can, preventing the conventional lids from seating properly on the can. It is an object of this invention to provide a garbage can lid that will be formed of flexible material, having a strap which may be mounted around the depending flange of the lid and that may be stretched to provide a grip on the can, and be locked in place to prevent the untimely removal of the lid.

SUMMARY OF THE INVENTION

A garbage can lid formed of flexible material having a vertical peripheral flange contoured to expand and contract, and a flexible strap on the lid having a latch movable into and out of locking position.

BRIEF DESCRIPTION OF THE DRAWINGS

FIG. 1 is an elevational view of a garbage can having partially been broken away and shown in cross section, and having a lid mounted thereon.

FIG. 2 is an elevational view of the lid mounted on the can, and showing means for locking the lid on the can.

FIG. 3 is a top view of the lid and locking means.

DESCRIPTION OF THE PREFERRED EMBODIMENT

The numeral 1 designates a garbage can of the usual contour, having the handles 2, 2. A lid 3, formed of flexible material, has a depending peripheral flange 4, and the usual handle 5. A flexible strip 6 is integral with the flange 4 and a rigid, laterally extended terminal 9 is integral with the one end of the strap 6, and a latch 7 is mounted on said terminal and a similar terminal 10 is mounted on the other end of the strap 6 on which an eye 8 is mounted and is adapted to receive the free end of the latch 7.

The lid being flexible, and the strap being flexible, the dents or bends of the can will not prevent the lid from being tightly mounted on the can, and the simple movement of the latch 7 out of engagement with the eye 8 to release the strap 6 and remove the lid 3, which will in no way interfere with the emptying of the can by the collector.

The strap is integral with the lid flange, and the flange at the point between the strap terminals, has a slot 11 to permit contraction of the flange when the strap is tightened and latched.

The lid may be of rubber, or other flexible material, and the flange 4 of greater diameter than the can 1 so that it will readily fit on the can. By stretching the strap by bringing the two terminals towards each other, and fastening the latch in place, the lid is tightly maintained on the can. To remove the lid, the latch is disengaged and the lid easily removed.

What I claim is:

1. In a garbage can lid formed of flexible material, a peripheral flange on said lid, a strap integral with said flange and having means for releasably anchoring the lid on the can, said strap being of flexible material and said means for maintaining said strap in holding position on the lid when the lid is mounted on the can consists of integral rigid terminals on the respective ends of said strap, and a hook pivotally mounted on one terminal and an eye for receiving the free end of said hook mounted on the other terminal.

* * * * *